343-700 MS AU 256 EX
10/30/79 OR 4,173,019

United States Patent [19]

Williams

[11] 4,173,019

[45] Oct. 30, 1979

[54] MICROSTRIP ANTENNA ARRAY

[75] Inventor: John C. Williams, Surrey, England

[73] Assignee: U.S. Philips Corporation, New York, N.Y.

[21] Appl. No.: 874,561

[22] Filed: Feb. 2, 1978

[30] Foreign Application Priority Data

Feb. 11, 1977 [GB] United Kingdom ..... 5707/77

[51] Int. Cl.[2] ..... H01Q 1/38

[52] U.S. Cl. ..... 343/700 MS; 343/846

[58] Field of Search ..... 343/700 MS, 846, 853, 343/854, 829, 830

[56] References Cited

U.S. PATENT DOCUMENTS

| | | | |
|---|---|---|---|
| 3,987,455 | 10/1976 | Olyphant | 343/700 MS |
| 3,995,277 | 11/1976 | Olyphant | 343/700 MS |
| 4,063,245 | 12/1977 | James et al. | 343/700 MS |

*Primary Examiner*—Eli Lieberman
*Attorney, Agent, or Firm*—Algy Tamoshunas

[57] ABSTRACT

A microwave antenna comprising a dielectric sheet with a ground conductor on one side and an array of antenna elements on the other side. The elements are connected in shunt by feeder lines which are inclined to the direction of polarization of the antenna. The elements may be fed from a common central feed point. A suitable pattern of feeder lines comprises a plurality of parallel regularly-spaced lines inclined at a given angle to the direction of polarization and intersected by a single feeder line inclined at a mirror-inverted angle to the direction of polarization. The feeder lines are suitably of much higher impedance than the elements. Power tapering across the antenna apertures giving good polar diagrams is readily obtainable with such an arrangement.

7 Claims, 9 Drawing Figures

MICROSTRIP ANTENNA ARRAY

The invention relates to a microwave antenna comprising a sheet of a dielectric material having a top and a bottom plane, an array of conductive antenna elements disposed on the top plane, a plurality of conductive feeder lines connected to these elements, and a conductive plate arranged parallel to and covering the entire bottom plane. The conductive plate is commonly referred to as a "ground plane", although it need not be planar, and the antenna may be described as a "microstrip" antenna.

Such an antenna has a wide range of uses in microwave technology. Since the spacing of the ground conductor from the elements and feeder lines is usually much less than the other dimensions of the antenna, the antenna is particularly suited for applications in which a small thickness is desirable or essential; consequent further advantages may be low weight and ruggedness. Thus the antenna may be suited for aerial navigation or aerospace use. Furthermore, the antenna may be fairly cheap to manufacture, and thus suited for use with for example, civil Doppler radars in intruder alarms and trafficlight control systems, and generally as detectors of relative movement.

The antenna may also be used in radio interferometers and transponders, for example for aircraft guidance or location, or for road vehicle location.

Various forms of microstrip antenna have been proposed. In one form described by J. R. James and G. J. Wilson at the 5th European Microwave Conference, 1975 ("New Design Techniques for Microstrip Antenna Arrays", pages 102–106 of the Conference Proceedings), the antenna elements are each approximately half of a microstrip wavelength ($\lambda_g$) long, being open-circuited at one end and joined at the other end to a feeder line extending perpendicular to the elements. A linear array consists of nine elements spaced along a rectilinear, open-circuit micro-strip feeder line at intervals of $\lambda_g$ (to achieve equality of phase excitation), with the first element directly at the (open-circuit) end of the line so that the elements in effect load the line at alternate high impedance points. James and Wilson report that experiments have indicated that the radiation resistance of an element depends on its width w (the resistance increasing with decreasing width) and hence if the element does not appreciably load the feeder line, varying the width w is a means of controlling the power radiated by the element.

With the aid of the Dolph-Chebyshev method it is possible to calculate the relative widths of the elements of the array in order that the variation along the array in the relative amounts of power radiated by the elements (hereinafter referred to as "power tapering") should produce a radiation pattern with a given sidelobe level; the central element of the array has the greatest width, and the widths of the outermost elements (for, theoretically, a sidelobe level of −24 dB and a beamwidth of approximately 8.5°) are 70% less. The lengths of the elements are second-order functions of the width, being calculated using T.E.M. relationships, and are then further corrected for dispersion effects. A constructed such array operating at 10 GHz is reported to have an H-plane sidelobe level of −20 dB and a bandwidth of 100 MHz.

An analogous 9×9 element two-dimensional array consists of nine parallel linear arrays all connected at one end to a main feeder line at intervals of $\lambda_g$ therealong. The main feeder line extends perpendicular to the feeder lines of the linear arrays and hence parallel to the elements so that collinear elements are also spaced at intervals of $\lambda_g$. The widths of the elements of each linear array vary along the array in the same ratios as before; to obtain power tapering parallel to the main feeder line, the widths of the centre elements of the nine linear arrays are also varied in the same ratios, so that the centre element of the entire array is the widest. For one such two-dimensional array, a sidelobe level in the H plane is reported as −17 dB and in the E plane, the side-lobe level is only −14 dB owing, it is said, to the dependence of the feed to each linear array on the considerable loading placed by the linear arrays on the main feeder line. The loading on the main feeder line may be relieved and the sidelobe levels improved (for example, to −20 dB) by scaling down the widths of the elements, but as the expense of reducing the already narrow bandwidth. Furthermore, a practical limit is imposed by the elements becoming too thin to be accurately formed. It may be noted that in this two-dimensional array, the centre, widest element is 4.7 mm wide, while the narrowest, outermost elements are only 9% of that width.

It is an object of the invention to provide a microwave antenna of the type mentioned in the preamble with which satisfactory performance may be obtained and which may be relatively simple to design and to make, without it being essential to have elements of different widths or lengths within the array, and which consequently may be reasonably cheap to design and manufacture.

The microwave antenna according to the invention is characterized in that the elements are arranged and fed by the feeder lines in such a way that the microwave antenna has a common linearly polarized radiation pattern and that at least two of the elements are interconnected by a first feeder line which over substantially all its length is at an angle unequal to $n\,\pi/2$ ($n=0, 1, 2, \ldots$) to the direction of polarization of the radiation pattern.

An advantage of an antenna embodying the invention is that a feeder line (which will itself tend to radiate when fed with microwave energy) at an angle unequal to $n\,\pi/2$ to the direction of polarization will interfere less with the H- or E-plane radiation pattern of the antenna than a comparable feeder line perpendicular or parallel to the direction of polarisation; cross-polarisation can also be reduced.

Furthermore, in a known array, parallel or substantially collinear elements are spaced at predetermined intervals in at least one direction because one or more feeder lines of the array extend perpendicular and/or parallel to that direction and because the relative phase of the radiated signals of the elements, dependent upon their electrical spacing along a feeder line, is predetermined by the desired direction(s) of the main lobe(s) of the antenna; for example, to obtain in-phase exitation of the elements for a planar array with a broadside main lobe (i.e. perpendicular to the plane of array), the elements must generally be spaced at intervals of $\lambda_g$ (or an integral multiple thereof). Consequently, the number of elements in said one direction determines the beamwidth in the plane of that direction, since this number determines the effective aperture of the array in said one direction. However, in an antenna embodying the invention, the spacing of the elements and hence the antenna aperture in said one direction can be altered, without altering the relative phase of the signals radiated by the elements or their number, merely by changing the shape and/or angle of inclination of the feeder line(s). Thus the beamwidth can be altered without altering the general form of the antenna, giving the antenna designer additional freedom.

The first feeder line may extend directly between the two elements. This forms a particularly simple arrangement, and is generally suitable for a broadside array.

At least a third element and the first feeder line may be interconnected by a second feeder line which over substantially all its length between the third element and the first feeder line is inclined relative to the polarization direction which is the mirror-inverted image of this direction of polarization relative to the angle between the first feeder line and the direction of polarisation. The second feeder line may extend directly between the third element and the first line.

This constitutes a useful basic unit for a range of different antennas embodying the invention; it may, for example, be used to excite the three elements in phase and, if desired, to feed them with equal powers.

The expression that one feeder line "extends directly" between two elements, or between an element and another feeder line is to be understood to mean that the one feeder line follows substantially the shortest path between the points at which the two elements, or the element and the other feeder line, respectively, are connected to the one line. Thus if, for example, the array is planar, the one feeder line (or at least the portion thereof between the two elements, or between the element and the other feeder line, if the one line extends beyond one or both said points of connection) is substantially rectilinear.

Where reference is made in this specification to the relative phase of the signals radiated by the elements, to the excitation or the feeding of power to one or more elements, or otherwise explicitly or implicitly to the use of the antenna for transmission, it should be understood that the antenna may in general equally well be used for reception, for which analogous statements may be made.

The antenna may comprise four or more elements connected to the feeder lines in shunt. Several elements can thus be connected to a single feeder line and power tapering obtained along the line.

The elements may be elongate, extend in the common direction and each be connected at one end to a feeder line; such an array is particularly suitable for an antenna with a fairly narrow beamwidth in at least one plane. The elements may each be connected at only one end to a feeder line and all extend away from that end in the same sense; such an arrangement is suitable for an antenna in which the elements are connected in shunt and are, for example, spaced along feeder-lines at intervals of one wavelength (or an integral multiple thereof) to obtain in-phase excitation. Each of the two last-mentioned arrangements is suitable for an antenna adapted for transmission or reception of electromagnetic signals with only one common direction of polarisation.

The antenna comprises a plurality of feeder lines inclined in the same sense to said common direction. This is suitable for a "two-dimensional" array (although such an array need not be planar).

All the feeder lines are connected to a common feed point for feeding microwave energy to or from all the elements. This can simplify connection of the antenna to other microwave circuitry.

Each element may be connected to the common point via a single feederline path. This may simplify the design of the antenna and may avoid one potential cause of a narrow bandwidth.

A pair of feeder lines enclosing an angle to the common direction in mutually opposite senses may be connected together, or in fact intersect one another, at the common point. This enables power tapering to be obtained in each of two non-parallel directions, and is particularly suited to a "centre-fed" array.

Embodiments of the invention will now be described with reference to the accompanying diagrammatic drawings, in which.

Figure 5A:
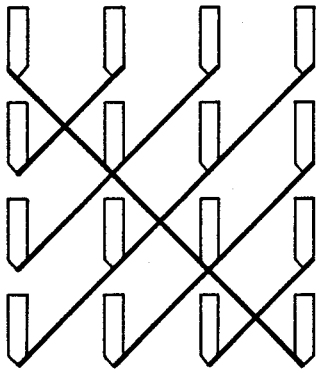
Figure 5B:
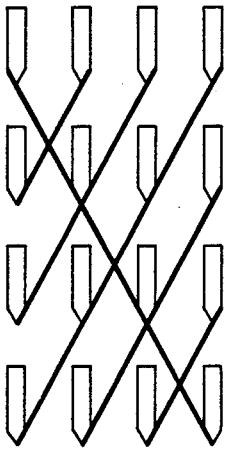
Figure 6:
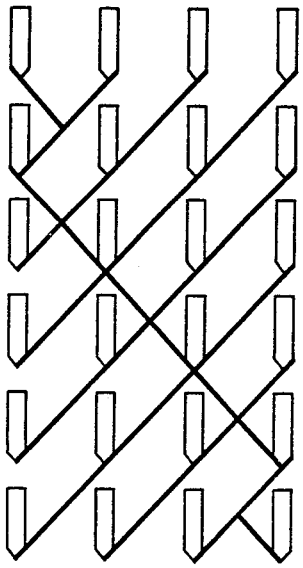
Figure 7:
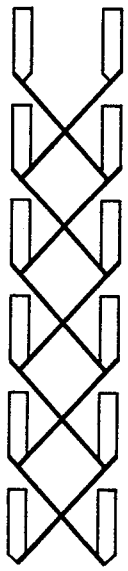
Figure 8:
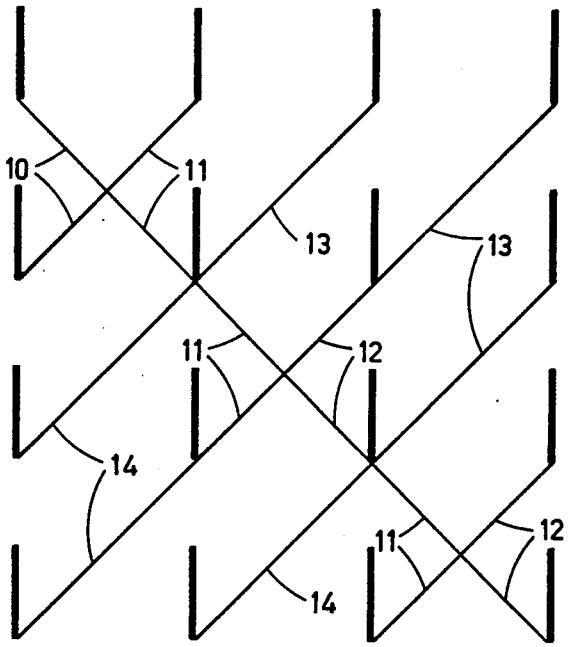

FIGS. 5*a* and 5*b* show a different embodiment of an antenna embodying the invention;

FIG. 6 shows a further embodiment of an antenna embodying the invention, comprising an array of $4\times6$ elements;

FIG. 7 shows yet another embodiment of an antenna embodying the invention, comprising an array of $2\times6$ elements, and FIG. 8 shows schematically yet another embodiment of an antenna embodying to the invention.

Figure 1:
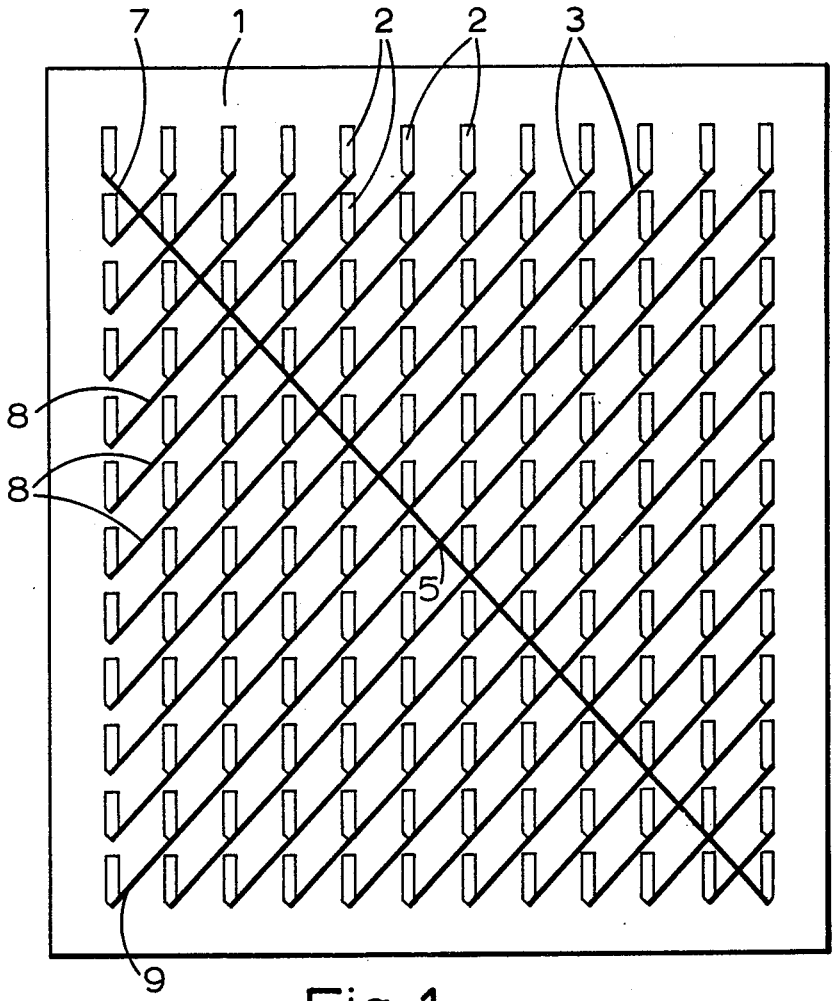
FIG. 1 is a plan view of an antenna embodying the invention, the antenna comprising an array of $12\times12$ elements.
Figure 2:
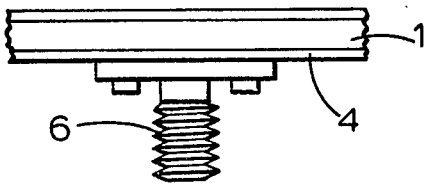
FIG. 2 is a fragmentary side view of a portion of the antenna of FIG. 1.

Referring to FIGS. 1 and 2, an antenna embodying the invention comprises a planar sheet 1 of dielectric material having a top and a bottom surface, having on the top surface (that shown in FIG. 1) both an array of conductive antenna elements, such as 2, and a plurality of rectilinear, feeder lines, such as 3, to which the elements are connected in shunt. On the bottom surface of the sheet 1 is a conductive sheet 4, called a ground plane. All the feeder lines, and hence all the antenna elements, are connected to a common feed point 5 on the sheet. A miniature coaxial connector 6 is secured to the bottom surface of sheet 1, the outer conductor of the connector being connected to the ground plane 4 and the inner conductor extending through an aperture in the sheet and being connected to a feed point 5 so that microwave energy can be fed to or from the elements or derived therefrom.

The antenna elements 2 are disposed in regularly-spaced parallel rows both vertically and horizontally. The elements are each connected at one end to a feeder line, extending away from that end in the same direction and the same sense, and have therefore a common radiation pattern with linear polarization (in the array of FIG. 2 a vertically polarized radiation pattern). The elements are of the same size and substantially rectangular, that end of each element which is connected to a feeder line being shaped as a small isosceles triangle the base of which forms the width of the element. The feeder lines 3 are all of the same width and hence the same characteristic impedance. This impedance is substantially higher than the characteristic impedance of the transmission line formed by each of the antenna elements, i.e. neglecting their radiation.

A first feeder line 7, inclined at an angle unequal to $n\ \pi/2$ ($n=1, 2, 3, \ldots$) to the common direction of polarization, extends diagonally across the array approximately from the top left-hand corner to the bottom right-hand corner. All the other feeder lines form a group of mutually parallel lines, such as 8, inclined at an angle unequal to n $\pi/2$ (n=0, 1, 2, 3, . . . ) to the common direction of polarization which is mirror-inverted relative to this direction, and which are therefore intersected by the first line 7. This group includes a second line 9 which extends across the array approximately from the bottom left-hand corner to the top right-hand corner, and intersects the line 7 at the common feed point 5.

In this embodiment, each element is connected to the common point 5 via a single path via the feeder-lines. The elements are electrically spaced one wavelength apart, i.e. physically spaced one micro-strip wavelength ($\lambda_g$) apart, along a feeder line or two intersecting feeder lines, the spacing being measured at the centre frequency of the operating band of the antenna. The group of parallel feeder lines 8 intersect the feeder line 7 at regular intervals of $\lambda_g/2$, with an element situated at alternate intersections along the line 7. When microwave energy at said frequency is supplied to the feed point 5, the elements are excited in phase, and the antenna produces a main lobe perpendicular to the plane of the array.

It will be seen that a basic "unit" of this embodiment comprises a pair of antenna elements directly interconnected by one feeder line inclined at an angle unequal to n $\pi/2$ (n=0, 1, 2, 3, . . . ) to the common direction of polarization, and another feeder line which extends directly from a point on the first-mentioned line, the point in some cases being mid-way between the two elements, to a third element and which is inclined at an angle to the direction of polarization which is mirror-inverted relative to this direction. Furthermore, each of the lines 8 connects to the line 7 (and in the case of line 9, directly to the common point) one or more pairs of elements, the two elements of each pair being on opposite sides of line 7 and their points of connection to the respective line 8 being equi-distant from the point of intersection of that line with line 7. Where two or more pairs of elements are connected to a line 8 (as is the case for each of the lines except the two most widely spaced), the elements form on each side of line 7 a series of progressively greater spacings from line 7; the same applies to the elements connected directly to the line 7 with regard to their spacings from the common point 5. The Figure shows that each horizontal row and each vertical row comprises a single element connected to the common point 5 by the line 9, and that the same applies to line 7.

Considering the antenna more closely, it is clear that since all the elements and all the feeder lines have the same respective impedances, their is substantial symmetry about each of the feeder lines 7 and 9 with regard to both the phase excitation of the elements relative to the common feed point and the relative amounts of energy radiated by the elements. However, because line 9 supplies energy from the feed point only to those elements directly attached to it whereas all the other elements of the array are supplied from line 7, either directly or via another of the lines 8, more energy is radiated by an element on line 9 than by an element not on that line but at the same distance from the feed point 5; this effect becomes more pronounced as the distance from the feed point increases. This asymmetry has been found useful to provide sufficient energy to at least a proportion of the elements relatively remote from the feed point.

With the arrangement of feeder lines used in this embodiment, the respective points of connection to feeder lines of elements equally electrically spaced along feeder-line paths from the common point 5 are disposed on two pairs of lines respectively parallel to the E and H planes of the antenna, the two lines of each pair being equidistant from and on opposite sides of the common point; since in this embodiment the array is planar, the lines form a rectangle centred on the common point, with elements of progressively greater spacing from the common point having their points of connection to feeder lines on respective rectangles of progressively greater dimensions. Thus the points of connection of the central four elements lie at the corners of the smallest rectangle, the corners being $\lambda_g/2$ from the point 5; the points of connection of the immediately surrounding eightteen elements lie on a rectangle the corners of which are 3 $\lambda_g/2$ from the point 5; the points of connection of the next surrounding twenty elements lie on a rectangle the corners of which are 5 $\lambda_g/2$ from the point 5, etc. As a result of this symmetry about the common feed point, the main lobe is necessarily substantially perpendicular to the plane of the array, independent of the frequency within the operable bandwidth.

By making reasonable estimates of, or measuring the proportion of the energy available to an element from a feeder line which is actually radiated by that element, one can calculate the relative amounts of energy radiated by the elements of the entire array when energy is supplied at the common point. If the total energy radiated for each horizontal row of elements is then calculated, it is found that the respective totals decrease progressively from a maximum for each of the central pair of adjacent rows (within the higher of which lies the common point 5) to minima for the two most widely separated rows (i.e. the uppermost and lowermost rows), the "power tapering" being symmetrical. An analogous result is obtained by finding the total energy radiated by the elements of each vertical row, the maximum occurring for each of the central pair of adjacent rows between which the point 5 lies. These procedures may each be considered as the notional division of the surface area of the sheet 1 over which the array extends into a group of parallel strips of equal widths, in one case horizontal strips each comprising one horizontal row of elements and in the other case vertical strips each comprising one vertical row of elements, the strips in both cases being centred on the elements therein. The relative totals of the energy for the strips of a group are thus a measure of the radiation per unit width of the array, and an indication of the power tapering across the vertical and horizontal apertures of the antenna.

Figure 3:
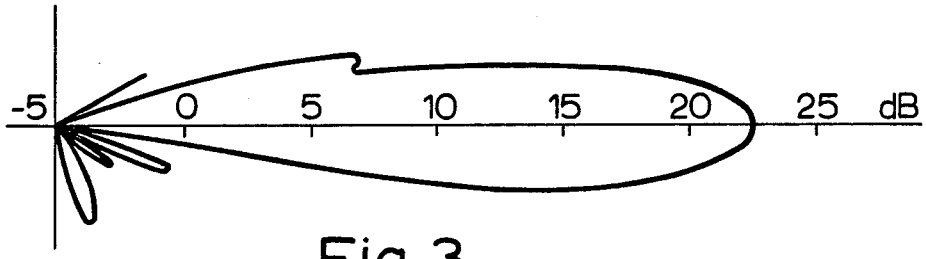
FIGS. 3 and 4 are polar diagrams, showing gain in dB.
Figure 4:
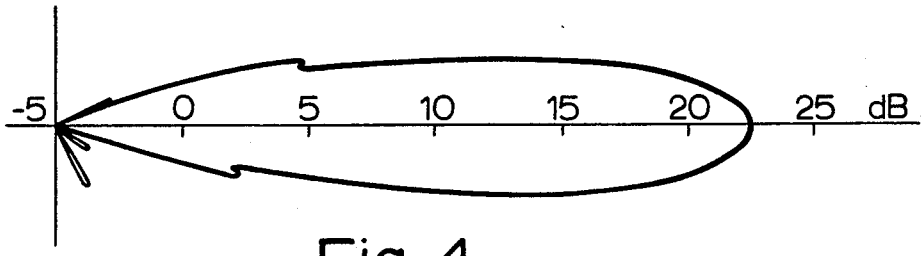

In the embodiment shown in FIGS. 1 and 2, the antenna was formed on a sheet, measuring about 19 cm×21 cm, of "Polyguide" of nominal thickness ≈0.15 cm, dielectric constant 2.3, copper-clad on both sides. The length of each of the antenna elements was about 1 cm, making their electrical length just under half a wavelength at the centre-band operating frequency of 10.5 GHz. The width of each of the elements was about 0.3 cm. The width of the feeder lines was about 0.04 cm, giving a characteristic impedance of about 150 ohms (thus roughly matching a 50 ohm coaxial line connected to the common feed point); microstrip transmission lines of the same width as the antenna elements (and on the same substrate) would have a characteristic impedance of about 60 ohms. The E-plane and H-plane polar diagrams measured with this antenna are shown approximately in FIGS. 3 and 4 respectively. The gain was about 22½ dB; the beam-widths (to −3 dB points) were about 9½° and 10° respectively, and disregarding the "ripples" (of less than 1 dB peak-to-peak) which occurred on the sides of the main lobe at about −15dB in the E-plane and at about −17 dB and −22 dB in the H-plane, the maximum sidelobe levels were better than −21 dB and −25 dB respectively. These results compare favourably with those quoted in IEE Journal on Microwave, Optics and Acoustics, Vol. 1, No. 5 (Sept. '77) by James and Wilson, pages 165–174 and by James and Hall, pages 175–181 for the above-mentioned known 9×9 element microstrip antenna (also constructed on 1/16 inch "Polyguide"). For comparison, it may be noted that:

(i) scaling this known antenna for operation at the same frequency as the above-described embodiment of the invention would require a dielectric sheet of similar dimensions to that of the embodiment, even though it would have fewer elements, since its horizontal and vertical rows of elements must be spaced at intervals of $\lambda_g$, while those in the embodiment are more closely spaced;

(ii) much less computation is required to design the embodiment of the invention.

The cross-polarization of the constructed embodiment was found to be lower than −25 dB. This is a very satisfactory figure, particularly for a microstrip antenna; according to J. W. Greiser (Microwave J., 19, No. 10, p. 47, Oct. 1976), a relatively high level of cross-polarization has been a problem with microstrip antennas, amounting in some cases to −8 to −10 dB.

The invention can thus provide a microwave antenna which is compact, which has a satisfactory performance, and which may be relatively easily and rapidly designed. Furthermore, as will be mentioned in more detail later, it may be relatively cheap.

There are two reasons for the favourable performance of the above-described constructed embodiment, namely:

(a) the relatively small contributions to the E-plane and H-plane polar diagrams from the feeder lines, owing partly to their angle to the direction of polarization of the antenna; this effect will of course be particularly marked when the feeder lines have high impedances, as in the above-described embodiment; and (b) the better approximation to a desired radiator by means of a "power taper" across an antenna aperture of predetermined size which is obtained by means of larger number of elements in the aperture than with the prior art radiator. The power taper with discrete antenna elements is a step-wise approximation to a smooth curve; this effect is most significant when the number of elements in the aperture is not very large.

Antennas with arrays of elements of the form shown in FIG. 1, comprising equal numbers of horizontal and vertical rows of elements and analogous patterns of feeder lines, have been constructed with arrays of various sizes between 2×2 elements and 24×24 elements for operation at various frequencies in the range of 9–14 GHz.

Antennas embodying the invention may conveniently be manufactured using copper-clad dielectric sheets; where the ground conductor is directly on the top or bottom surface of the sheet, a sheet clad on both surfaces can be used. The array of antenna elements and the feeder lines may be produced from the cladding on one surface by conventional photolithographic and etching techniques, exposing a layer of photoresist material on the cladding through a mask having the desired final conductive pattern. It has been found possible to make antennas of the form shown in FIG. 1 but comprising different respective numbers of elements and suitable for operation at different respective frequencies from a single "master" mask. This master, representing an array of 24×24 elements, can be used to produce a subsidiary mask from which the desired antenna is made. For arrays smaller than 24×24 elements, parts of the master are blanked off to produce the subsidiary; to alter the frequency of operation, the optical magnification is adjusted appropriately in producing the subsidiary mask. While the performance of antennas made by this method may in general not be as good in all respects as could be obtained by careful individual design, it may well be sufficiently good for a number of application, and the reduction in the cost of design and manufacture, particularly for small numbers of a large variety of different antennas, will be evident.

Various dielectric materials other than that of "Polyguide" can be used for the dielectric sheet. For example, a number of satisfactory antennas have been made on "CIMCLAD", a copper-clad random glass-fibre mat reinforced polymeric ester sheet available from Cincinatti Milacron; 0.15 cm thick sheet, type MB (dielectric constant approximately 3.8) was used. This laminate is particularly intended for radio and television printed circuit boards; it has the disadvantage of a higher dielectric loss than that of for example "Polyguide", resulting in reduced gain, but it has the advantage of being particularly cheap, and is thus advantageous for application in which low cost is desirable and a somewhat reduced gain is acceptable, such as Doppler radar intruder alarms with limited range. The reduction in gain (by comparison with a lower-loss dielectric) will obviously tend to increase as the size of the array and hence the lengths of the feeder lines increase; as an example, the difference in gain between antennas (with equal numbers of elements) having a gain of about 15 dB and constructed on "Polyguide" and "CIMCLAD" was about 1 dB.

It has been found that the elements in antennas of the form of FIG. 1 appear to have a broad bandwidth. For example, elements all having the same length of about 1 cm have been used in antennas formed on ≈0.16 cm thick "Polyguide" and operating at different respective frequencies in the range of 9.1–10.7 GHz; although better results might have been obtained by slight alterations in length, useful performance was obtainable with this single length. This simplicity in design again compared favourably with the above-mentioned known 9×9 element microstrip antenna comprising elements of different widths, for which two corrections were made to the lengths of elements of each of the widths.

The bandwidth (in terms of gain, for example between −1 dB points) of constructed embodiments of the invention appears to be mainly dependent on the change with frequency of the relative phase excitation of the elements of the array. Thus for a particular form of the radiation function with power tapering, the bandwidth will tend to decrease with increasing size of the array.

By way of example, the gain and Standing Wave Ratio measured for three constructed antennas of the general form of FIGS. 1 and 2 are given in the Table below. Of the three antennas, designated A, B and C respectively, A and B were formed on ≈0.16 cm thick "Polyguide" and C was formed on ≈0.16 cm thick "CIMCLAD". The array sizes were: A: 4×4 elements; B: 8×8 elements; C: 10×10 elements.

TABLE

| | Frequency (GHz) | Gain (dB) | VSWR |
|---|---|---|---|
| | 8.82 | 15 | 1.7 |
| | 8.92 | 16 | 1.5 |
| | 8.96 | 15½ | 1.38 |
| | 9.02 | 15½ | 1.28 |
| A | 9.09 | 16 | 1.38 |
| | 9.12 | 16 | 1.5 |
| | 9.14 | 16 | 1.7 |
| | 10.60 | 19 | 1.40 |
| | 10.70 | 20½ | 1.30 |
| | 10.80 | 20½ | 1.22 |
| B | 10.97 | 21 | 1.30 |
| | 11.02 | 20 | 1.38 |
| | 11.04 | 19 | 1.60 |
| | 12.35 | 17½ | 1.38 |
| | 12.40 | 19 | 1.32 |
| | 12.45 | 19½ | 1.28 |
| | 12.50 | 19½ | 1.30 |
| C | 12.55 | 19½ | 1.26 |
| | 12.60 | 19½ | 1.28 |
| | 12.65 | 19½ | 1.32 |
| | 12.70 | 18 | — |

Since, for any given thickness and type(s) of dielectric between the array of elements and the ground conductor, the radiation resistance of an element is dependent on one or more of its dimensions (for example with a rectangular element fed at one end, on its width), the power tapering across an array with a fixed number of elements at fixed positions and with a fixed general pattern of feeder lines can, if desired, be varied by making different elements of the array with different widths. However, this has not been found to be necessary in any of the constructed embodiments, satisfactory results being achieved with arrays in which the elements are respectively all of the same size. However, to obtain the same form of power tapering across arrays of different sizes (but with analogous patterns of feeder lines), it will, in general, be necessary to decrease the widths of the elements as the total number of elements increases, because otherwise, for example, an insufficient proportion of power would be radiated by elements relatively far from the feed point.

The power tapering could also be controlled by varying the characteristic impedance of the feeder lines; an antenna may for example, comprise feeder lines of different respective characteristic impedances. In order to obtain optimum performance as regards, for example, VSWR for the complete array, it may be necessary to determine the impedance(s) of the feeder lines in accordance with, inter alia, the number of elements.

Although the antenna of FIGS. 1 and 2 has substantially equal vertical and horizontal apertures and consequently substantially equal E-plane and H-plane beamwidths, it is possible to make arrays which provide significantly different E-plane and H-plane beamwidths without necessarily altering the numbers of rows or the number of elements but by merely altering the angle between the feeder lines to the direction of polarization and thereby altering the spacings of the horizontal and vertical rows. An example of this is shown schematically in FIGS. 5*a* and 5*b*, both of which show regular arrays of 4×4 elements with the same general pattern of feeder lines as the array of FIG. 1. In the array of FIG. 5*a*, the apertures are approximately equal; in the array of FIG. 5*b*, the vertical aperture is roughly 1½ times the horizontal aperture, giving a smaller beamwidth in the E-plane than in the H-plane. Clearly, the range over which the angles of inclination can be varied will be limited by geometrical and technological factors; for example, the feeder lines must not contact or by closely adjacent to di-poles other than those to or from which they should feed energy. Furthermore, with a fixed general pattern of feeder lines and a fixed number of elements spaced a fixed distance apart along the feeder lines, as one aperture increases, the orthogonal aperture decreases. Nevertheless, this feature of the invention does provide a significant additional degree of freedom for the antenna designer. By way of example, two antennas comprising respectively 4×4 and 6×6 elements have been constructed with beamwidths of 26°×30° and 24°×19° (E-plane×H-plane respectively).

An antenna embodying the invention and comprising, for example, a regular array of elements disposed in orthogonal rows need not have equal numbers of rows in the orthogonal directions. Where, for example, it is desired to use a given form of feeder-line pattern with a given angle to the common direction of polarisation, or to have a given beamwidth in the E- and H-planes that differ to a greater extent than can conveniently be provided merely by choosing a suitable angle for the feeder lines to the common direction, different numbers of rows in the two directions may be used. FIGS. 6 and 7 show by way of example arrays of 6×4 elements and 6×2 elements respectively, differing modifications of the feeder-line pattern of FIG. 1 being used in the two arrays. The arrangement of FIG. 6 requires modification of the feeder-line pattern of FIG. 1 only at two diagonally opposite corners of the array, and is considered particularly suited for arrays in which the two numbers of rows do not greatly differ and in which the total number of elements is not small. On the other hand, the arrangement of FIG. 7 is suitable where markedly different E-plane and H-plane beamwidths are required (for example, in radio interferometers): the symmetrical disposition of the feeder lines in this emodiment is considered desirable for feeding the two elements in each horizontal row with equal amounts of power.

An array of elements need not comprise parallel rows with the same number of elements in each row. For example, the array of FIG. 1 may be modified to provide an array of approximately triangular outline by omitting the portion of the line 7 and all those lines 8 (together with their associated elements) to the right of and below line 9. Other possible modifications, including other triangular arrays, which can be formed by omission of a portion of the array of FIG. 1 will be apparent.

An embodiment of the invention in which the elements are, for example, arranged in regularly-spaced rows need not comprise an even number of rows. For example, with a feeder-line pattern analogous to that of FIG. 1, there may be odd numbers of horizontal and vertical rows, with the four elements nearest the common feed point spaced $\lambda_g$ (rather than $\lambda_g/2$) therefrom. It may be desirable to omit the element which could then be fed directly at the common point if its inclusion would result in excessive radiation from this region relative to the radiation from the other elements of the array and hence in an undesirable form of power tapering. The omission of this central element is unlikely, at least in relatively large arrays, to have a marked adverse effect.

The elements need not be arranged in regularly spaced parallel rows. It may, for example be desirable to have irregular spacing of the elements (with appropriate relative phasing) to obtain a particular form of polar diagram (as regards, for example, the shape of the main lobe or the levels of the sidelobes).

Antenna elements which are to be excited in phase need not be spaced along a feeder line at intervals of $\lambda_g$ (or an integral multiple thereof). For example, where the elements are elongate, extend in the common direction of polarization and are each connected at only one end to a feeder line, they may be spaced at intervals of $\lambda_g/2$ (or an odd multiple thereof), with successive elements extending away from the line in the common direction alternately in opposite senses. An analogous arrangement with spacing intervals other than $\lambda_g/2$ could be used for out-of-phase excitation.

The antenna elements need not be substantially, rectangular, but may for example be elliptical.

The antenna elements need not be connected in shunt. Instead of a single point on an element being connected to one or more feeder lines, a series connection of, for example, rectangular elements may be made with two feeder lines connected to opposite ends of an element.

It will be appreciated that the use in a micro-wave antenna of feeder lines inclined at an angle with respect to the common direction of polarization unequal to $n\pi/2$ ($n=0, 1, 2, 3$) is particularly (although not exclusively) suited to a "centre-fed" array, this configuration is commonly desirable, but in known microstrip antennas can be difficult or inconvenient to obtain. As mentioned above, the symmetry of a centre-fed configuration such as that of FIG. 1 results in a main lobe which is necessarily normal to the array. To obtain a "squinting" array, i.e. one in which the main lobe is inclined to the normal on the dielectric plane, it is necessary to use a feeder-line arrangement such that elements are not excited in phase and that there is a progressive effective phase change (i.e. where appropriate, disregard integral multiples of $\lambda_g$) in at least one direction across the whole array. One way of attaining this result is for the array to be at least partly "end-fed". For example, in the above-mentioned array of triangular outline comprising roughly half the array of FIG. 1 spacing the parallel feeder lines so that they intersect the one other feeder line at intervals not equal to $\lambda_g/2$ would cause the main lobe to be inclined along that one line. As an alternative, the elements may be fed from one or more edges of the array only by mutually non-intersecting lines. The elements need not be connected to a common feed point on the dielectric sheet; in the last-mentioned arrangement, for example, the feeder lines may in operation be supplied with micro-wave energy via a detachable edge connector.

A further alternative way of obtaining a squinting main lobe is to use a centre-fed array with the elements disposed in regularly-spaced rows but with the feeder lines arranged so that the effective electrical spacing between elements varies across the array. FIG. 8 shows schematically a $4\times4$ element planar array using five values of effective electrical lengths of portions of feeder line denoted 10 to 14 inclusive respectively between adjacent elements or between an element and an adjacent point of intersection of feeder lines. By using the following values for the lengths of the portions:

10: $\lambda_g/2-\delta\lambda_g$
11: $\lambda_g/2$
12: $\lambda_g/2+\delta\lambda_g$
13: $\lambda_g-\delta\lambda_g$
14: $\lambda_g+\delta\lambda_g$ the elements in each vertical row will be respectively in phase, but there will be a phase difference equivalent to $\delta\lambda_g$ between successive vertical rows, so that the main lobe will be inclined to the normal in the H-plane (as drawn, to the right if $\delta\lambda_g$ is positive). To obtain the requisite lengths of the portions of feeder lines will of course result in at least the majority of the portions of feeder line not extending directly between adjacent elements or between an element and another feeder line.

Beam steering can be obtained by including electrically-controllable phase-shifting means, such as p-i-n diodes, in the feeder lines. For example, the array of FIG. 8 may include in each of the portions of feeder line 10, 12, 13 and 14 a phase-shifter for producing a phase delay $\delta\lambda_g$, and the lengths of the portions 10–14 (i.e. when the phase-shifters are not operating) may be as follows:

10: $\lambda_g/2-\delta\lambda_g$
11: $\lambda_g/2$
12: $\lambda_g/2$
13: $\lambda_g-\delta\lambda_g$
14: $\lambda_g$ Thus, when only the phase-shifters in the portions 12 and 14 are operating, the main beam will squint in the H-plane as before, and when only the phase-shifters in the portions 10 and 13 are operating, the main beam will be normal to the plane of the array.

In view of the above-mentioned relatively large bandwidth of suitable individual antenna elements, the direction of the main lobe of a squinting array may also be changed by altering the operating frequency within the bandwidth of the elements.

The ground conductor of an antenna embodying the invention need not be formed or located directly on the reverse surface of the dielectric sheet, nor need the array be planar. For example, a rigid curved dielectric sheet may be used, or the array of antenna elements and the feeder lines may be formed on one surface of a flexible dielectric sheet which is subsequently secured to a rigid conductive surface (planar or curved) which in operation serves as the ground conductor (ground plane).

A dielectric other than that of the sheet may be present between the array and feeder lines and the ground conductor. For example, a rigid dielectric sheet supporting the array and feeder lines may itself be supported so as to be separated by an air gap from the ground conductor. Such an arrangement may be useful for antennas operating at relatively low micro-wave frequencies, in order to reduce the amount of solid dielectric material required.

It appears desirable that the spacing between the elements of the array and the ground conductor should not be very small, for this tends to result in poor gain and/or a very small bandwidth. This spacing may conveniently be given in terms of the electrical spacing, i.e. the spacing in terms of the wavelength $\lambda_d$ of electromagnetic radiation at the operating frequency travelling from an element of the array to the ground conductor, $\lambda_d$ being equal to $\lambda_o/n\epsilon$, where $\lambda_o$ is the free-space wavelength and $\epsilon$ is the dielectric constant of the dielectric medium between the element and the ground conductor at that frequency, $\epsilon$ being a spatial average if there are two or more different dielectrics, for example if there is an air gap between the ground conductor and the dielectric sheet supporting the elements. Experiments suggest that a suitable lower limit to the electrical spacing is approximately 0.05 $\lambda_d$. In the above-mentioned embodiments constructed on $\approx$0.16 cm "Polyguide" and $\approx$0.16 cm "CIMCLAD", the electrical spacings were approximately 0.08 $\lambda_d$ and 0.11 $\lambda_d$ respectively.

At also appears desirable for the electrical spacing not to be too large. For example, an experiment was performed on an antenna embodying the invention, operable at 3 GHz and using a fibre-glass material of dielectric constant approximately 4.8 as the only dielectric between the array and the ground conductor. The thickness of the dielectric was increased in steps of $\approx$0.16 cm from 0.16 cm to $\approx$1.1 cm; it was found that the gain was highest with thicknesses of 0.64 to 0.80 cm corresponding to 0.12 $\lambda_d$ and 0.15 $\lambda_d$.

What is claimed is:

1. A microwave antenna comprising a dielectric sheet having a conductive sheet on one major surface thereof and having on the other major surface thereof opposite said conductive sheet a first and second conductive feeder line connected to each other at a common point therealong and a first and second plurality of antenna elements connected to said first and second lines, respectively, at spaced locations therealong to define an antenna array having a linearly polarized radiation pattern, said first and second plurality each including at least two of said antenna elements connected at immediately adjacent locations along the respective feeder line and spaced from each other both parallel and perpendicular to the direction of polarization, said first and second feeder lines being inclined in mutually opposite directions over substantially all of the length thereof between said immediately adjacent locations at an angle other than $n\pi/2$, where n equals 0, 1, 2,..., with respect to the direction of polarization.

2. The antenna according to claim 1 wherein at least one of said two feeder lines extends directly between said immediately adjacent locations at which the respective two elements are connected thereto.

3. The antenna according to claim 1 wherein said common point lies between said respective immediately adjacent locations on each of said lines.

4. The antenna according to claim 1 wherein, for at least one of said feeder lines, said immediately adjacent locations at which the respective two elements are connected thereto lie respectively nearer to and further from said common point and both of said immediately adjacent locations lie on the same side of the other of said lines, and wherein said one feeder line is inclined to the direction of polarization over substantially all the length thereof between said common point and the nearer location at substantially the same angle as the portion of said one line extending between said immediately adjacent locations.

5. The antenna according to claim 1 including a plurality of feeder lines comprising a set of mutually non-intersecting feeder lines each having a respective plurality of said elements connected thereto at spaced locations therealong, said set including said first feeder line, a portion of each of the other lines in said set extending between two immediately adjacent locations at which two elements are spaced from one another both parallel and perpendicular to the direction of polarization are connected thereto being inclined to the direction of polarization in the same direction as the portion of said first line extending between said immediately adjacent locations at which said at least two elements are connected thereto.

6. The antenna according to claim 5 wherein said feeder lines of said set are interconnected by said second feeder line.

7. The antenna according to claim 5 wherein said elements are elongated, aligned in the direction of polarization and connected at only one end thereof to the respective feeder line.

* * * * *